US005194320A

United States Patent [19]

Groshens

[11] Patent Number: 5,194,320

[45] Date of Patent: Mar. 16, 1993

[54] HEAT BONDING TEXTILE FOR LININGS AND A METHOD OF MANUFACTURING SAME

[75] Inventor: Pierre Groshens, Peronne, France

[73] Assignee: Lainiere de Picardie, Perrone, France

[21] Appl. No.: 486,321

[22] Filed: Feb. 28, 1990

[30] Foreign Application Priority Data

Mar. 8, 1989 [FR] France ..... 89 030045

[51] Int. Cl.[5] ..... B32B 7/00; A41D 27/02

[52] U.S. Cl. ..... 428/230; 428/102; 428/253; 428/257; 428/261; 2/272

[58] Field of Search ..... 428/102, 103, 170, 171, 428/253, 257, 232, 236, 284, 293, 295, 230; 66/84 A, 190; 2/272

[56] References Cited

U.S. PATENT DOCUMENTS

| | | | |
|---|---|---|---|
| 3,279,221 | 10/1966 | Gliksmann | 66/192 |
| 3,600,259 | 8/1971 | Smith et al. | 428/253 |
| 3,837,943 | 9/1974 | Ploch et al. | 156/93 |
| 4,148,958 | 4/1979 | Tischer et al. | 428/196 |
| 4,388,364 | 6/1983 | Sanders | 428/253 |
| 4,435,467 | 3/1984 | Rogers | 428/254 |
| 4,450,196 | 5/1984 | Kamat | 428/197 |
| 4,737,396 | 4/1988 | Kamat | 428/197 |
| 4,854,135 | 8/1989 | Petracek et al. | 66/190 |
| 4,869,081 | 9/1989 | Groshens | 66/192 |
| 5,065,599 | 11/1991 | Groshens | 66/84 A |

FOREIGN PATENT DOCUMENTS

| | | |
|---|---|---|
| 289378 | 11/1988 | European Pat. Off. . |
| 1456049 | 11/1976 | United Kingdom . |

*Primary Examiner*—George F. Lesmes
*Assistant Examiner*—Christopher Brown

[57] ABSTRACT

The invention relates to a heat-bonding textile (1) for linings and a method of manufacturing same. It comprises:

a non-woven textile layer (2),
a weft (3),
a knitted thread (4) providing the connection between the weft (3) and the non-woven textile layer (2),
a heat-bonding adhesive layer (5).

According to the invention, the weft (3) is formed of threads (6) having undergone high shrinkage subsequent to its association with the textile layer.

15 Claims, 1 Drawing Sheet

HEAT BONDING TEXTILE FOR LININGS AND A METHOD OF MANUFACTURING SAME

The invention relates to a heat-bonding textile for linings and a method of manufacturing same.

It relates more particularly to heat-bonding textiles for lining garment fronts, reinforcements for same or false fronts.

These products are intended to give to the textiles or fabrics to which they are fixed and to the clothes, the desired feel, suppleness and pliancy.

Different proposals have already been made for producing heat-bonding textile for linings incorporating a non woven textile layer.

For example, in the patent FR-A-2 223 496 a web is described comprising at least one layer of non-woven and non oriented fibres and at least one layer of additional fibres having a high degree of orientation. These layers are sewn together by synthetic threads and coating thereof for forming a heat-bonding product is envisaged.

According to U.S. Pat. No. 3,600,259, a heat-bonding textile is also described formed of a non woven textile layer stabilized by knitting whose stitches pass through it. This textile is then coated with a thermo-adhesive layer. U.S. Pat. No. 4,737,396 and U.S. Pat. No. 4,450,196 also describe products of similar structure.

Furthermore, from for example the document FR-A-2 283 972 coated fabrics with woven stitches are also known for forming reinforcement fabrics, for example for garment fronts.

The different products resulting from the "MALI" technique, comprising a knitted fabric of weft threads in a crossed layer, a knitted fabric of a web of fibres with threads ("MALIWATT" technique) or the association of these two methods have been used for many years in linings.

The heat-bonding textiles incorporating a non-woven layer have great flexibility but do not offer sufficient pliancy.

Woven stitch reinforcement fabrics are the most widely used. They give satisfactory results but it is useless for certain applications for increasing their volume and reducing their weight.

The object of the present invention is therefore a heat-bonding textile for linings which, while remaining light, has considerable volume and at the same time good pliancy.

For this, a heat-bonding lining textile is proposed of the type comprising a non-woven textile layer, a weft, a knitted thread ensuring the connection between the weft and the non-woven textile layer and a heat-bonding adhesive layer. According to the invention, the weft is formed of threads having undergone considerable shrinkage subsequent to their association with the non-woven textile layer.

The invention further relates to a method of manufacturing a heat-bonding lining textile of the type in which a non-woven textile layer is formed, the connection of this layer with a weft is carried out on a "RACHEL" loom using a sewing thread, the textile thus obtained is finished, and a layer of thermo-adhesive coating is deposited. According to the invention, during finishing, the weft undergoes considerable shrinkage.

The invention will be described in greater detail with reference to the figures in which.

Figure 2:
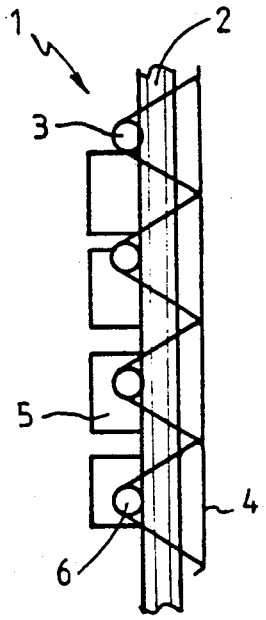
FIG. 2 is a schematic view of the heat-bonding textile of the invention seen in section.
Figure 1:
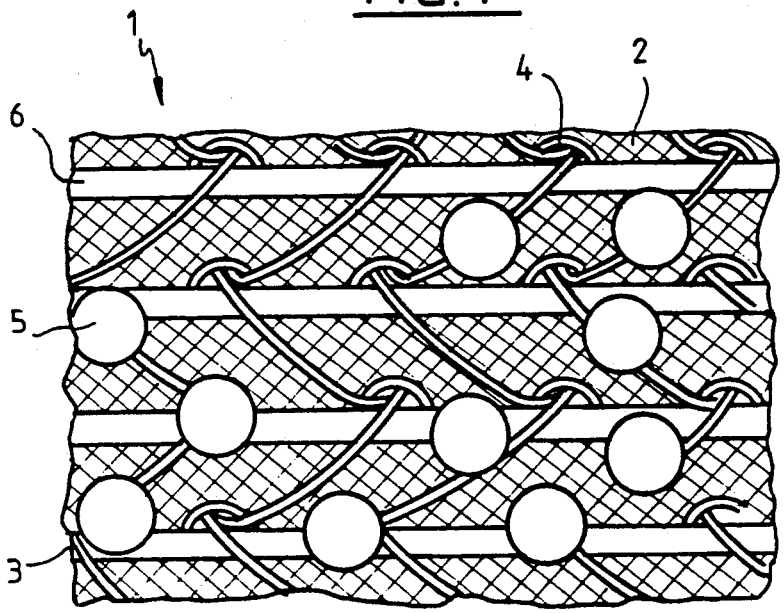
FIG. 1 is a schematic view of the heat-bonding textile of the invention seen from above.

The heat-bonding lining textile 1 comprises a non-woven textile layer 2.

The purpose of this layer 2 is mainly to give the heat-bonding textile a considerable volume with respect to its weight. It is made from a layer of uncompacted fibres and possibly undergoes minimum bonding in order to give just sufficient cohesion to the fibres for preventing the surface fibres from catching on the knitting members before association thereof with weft 3.

The layer of weakly bonded and so unresistant fibres will be transported without tension as far as the knitting front.

This bonding may be provided by hot calendaring. In this case, the fibres of this non-woven textile layer 2 are preferably formed of a two component polyamide, one of them being capable of melting and providing bonding by calendaring.

This non-woven textile layer 2 may also be formed of synthetic fibres, for example made from polyester or polyamide, or even with natural and artificial (for example viscose) fibres. Weak bonding of this non-woven textile layer may be provided by needling.

The heat-bonding textile lining textile comprises a weft 3 formed of threads 6. This weft 3 is preferably a straightforward weft.

A knitted thread 4 ensures the connection between weft 3 and the non-woven textile layer 2. It may be multifilament.

To this end, the non-woven textile layer 2 forms a bottom which is transpierced by the needles during knitting. The knitted fabric is preferably an overstitch knitted fabric and weft 3 is preferably inserted during knitting.

According to an important feature of the invention, the threads 6 of weft 3 are capable of high shrinkage during finishing. Since such shrinkage reduces the width of the non-woven textile layer it gives it a volume greater than that it had initially and so a better relief. This method of associating a non-woven layer 2 and a shrinkable weft 3 makes it possible to obtain a heat-bonding textile lining textile having elasticity controlled in the direction perpendicular to weft 3 whereas it has good pliancy in the direction of weft 3, while keeping a stretchability determined by the shrinkage treatment conditions.

Different threads are known having a high shrinkage capacity on finishing (high bulk). These threads may be textured polyester or polyamide threads comprising continuous filaments to which a curling memory has been given during their manufacture according to a known technique.

These threads are momentarily fixed at their maximum length and when they are subjected to the finishing treatment, by the effect of the temperature or an adequate aqueous treatment, they assume a new configuration giving to the threads which incorporate them a dimension less than their initial dimension. Preferably, the rate of shrinkage of the weft is at least 15%. But it may reach 40%.

Shrinkable fibre threads (for example acrylic high bulk) may also be used.

The presence of weft 3 on one of the faces of the non-woven textile layer gives to the heat-bonding textile of the invention disymmetric properties. Surprisingly, it has been discovered that it is preferable, during use of a heat-bonding textile, to locate weft 3 in contact with the garment. The pliancy thus obtained is therefore greater. For this reason, weft 3 and the adhesive layer 5 are preferably on the same side of the non-woven layer 2.

Since shrinkage of weft 3 reduces the width of the non-woven layer 2, it therefore increases its mean thickness which was compressed during knitting and so its volume by forcing the fibres to a curling effect under the action of the shrinkage. The shrinkage of weft 3 will preferably be produced during finishing. However, other means may be envisaged for producing such shrinkage.

By way of example, a heat-bonding textile lining according to the invention may have a density of 70 to 100 g per $m^2$ for forming garment fronts or reinforcements therefor. The heat-bonding textile adhesive layer is made by coating by spots of 2 to 17 mesh for example (number of spots of heat-bonding textile material in a square whose diagonal measures 2.4 cm (1 inch)). The heat-bonding textile material forming the adhesive layer can be any one of those currently used for bonding reinforcement fabrics on the fabrics receiving them. They may be based on vinylic polymers, polyolefins, polyamides, . . .

These substances may be in powder or paste form. The usual coating methods can be used. The preferred method is that of impression printing of silk-screen printing type.

According to the method of the invention, a non-woven textile layer is formed first of all.

Numerous methods of manufacturing non-woven textile layers are known per se; any one of them may be used for forming the non-woven textile layer of the heat-bonding textile according to the invention.

The non-woven layer 2 used is very little compacted and it is slightly bonded.

Such bonding may be achieved by hot calendaring or else this non-woven textile layer may be lightly needled or pre-needled, for example with a needle penetration density of 20 to the $cm^2$.

The non-woven layer is formed of polyamide, polyester fibres or else natural or artificial fibres.

This textile layer 2 is fed into a "RACHEL" loom also called "warp knitting loom" with weft insertion.

Figure 3:
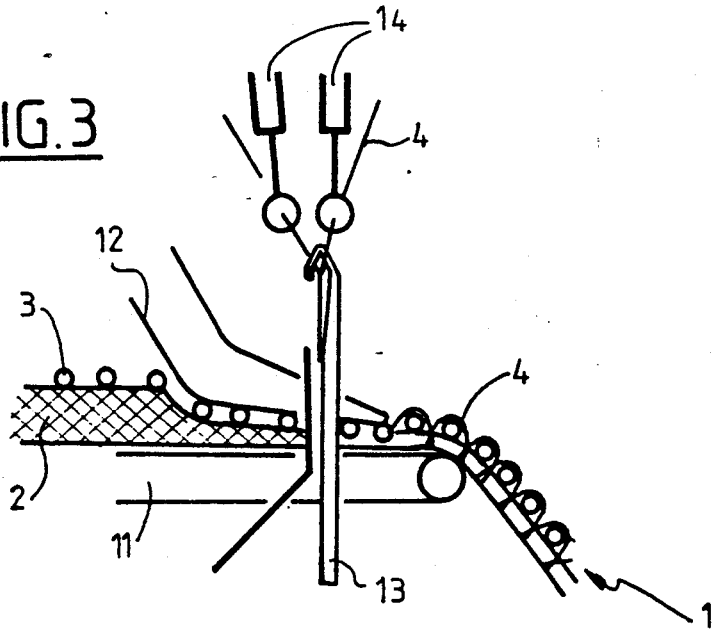
FIG. 3 is a schematic view of the formation of the basic textile on a "RACHEL" loom.

A "RACHEL" loom is shown schematically in FIG. 3. Weft 3 is laid on the non-woven layer 2. The assembly is slightly compressed between the front 11 and the beating plate 12. The compound needle 13 cooperates in a way known per se with the heddle hook bar 14 for forming the knitted fabric.

Thus, the non-woven textile layer 2 is transpierced by needles 13 of the loom and is therefore inserted in the knitted fabric and held thereby. In addition, the loom inserts a weft 3 into the knitted fabric and so at the surface of the non-woven textile layer 2.

Subsequent to this association, the weft threads 6 undergo shrinkage which, reducing their dimension, causes a reduction of the width of the textile formed so of the non-woven layer 2 and increases it volume.

The textile is then subjected to conventional finishing operations, the shrinkage may occur during these operations.

Then a thermo-adhesive coating layer is deposited on the textile. This coating is preferably spot coating and is provided for example by an etching cylinder of the silk-screen printing type.

The invention makes it possible to obtain a heat-bonding textile for lining whose volume is greater than that which would naturally be conferred thereon by the non-woven textile layer, whose pliancy is greatly determined by the properties of the weft threads.

I claim:

1. A heat-bonding lining textile comprising:

a non-woven textile layer having first and second faces, said non-woven textile layer comprising a layer of uncompacted fibers;

a weft on said first face of said non-woven textile layer;

a knitted thread connecting said weft and said non-woven textile layer; and a heat-bonding adhesive layer on said first face of said non-woven textile layer;

wherein said weft is formed of threads capable of high shrinkage under the effect of heat;

wherein after said weft is connected to said non-woven textile layer by said knitted thread, said weft is subjected to shrinkage treatment conditions to undergo high shrinkage;

wherein said non-woven textile layer has a reduced width and increased mean thickness and volume as a result of said high shrinkage of said weft;

wherein said lining textile has elasticity controlled in a direction perpendicular to said weft and good pliancy in the direction of said weft as a result of said high shrinkage of said weft; and wherein said lining textile has a stretchability determined by said shrinkage treatment conditions.

2. The lining textile of claim 1, wherein said weft has a rate of shrinkage of between 15% and 40%.

3. The lining textile of claim 1, wherein said threads of said weft are made from polyester.

4. The lining textile of claim 1, wherein said threads of said weft are made from polyamide.

5. The lining textile of claim 1, wherein said threads of said weft are curl memory threads.

6. The lining textile of claim 1, wherein said non-woven textile layer is partially bonded by hot calendaring before associated with said weft.

7. The lining textile of claim 6, wherein said fibers of said non-woven textile layer are formed of a bi-component polyamide.

8. The lining textile of claim 1, wherein said non-woven textile layer is lightly needled.

9. The lining textile of claim 8, wherein said fibers of said non-woven textile layer are made from polyamide.

10. The lining textile of claim 8, wherein said fibers of said non-woven textile layer are made from polyester.

11. The lining textile of claim 8, wherein said fibers of said non-woven textile layer are natural fibers.

12. The lining textile of claim 8, wherein said fibers of said non-woven textile layer are artificial fibers.

13. The lining textile of claim 12, wherein said fibers of said non-woven textile layer are made from viscose.

14. The lining textile of claim 1, wherein said knitted thread is a multifilament synthetic thread.

15. A heat-bonding lining textile comprising:

a lightly-needled, non-woven textile layer having first and second faces, said non-woven textile layer comprising a layer of uncompacted fibers, and said fibers being formed of a bi-component polyamide;

a weft on said first face of said non-woven textile layer;

a knitted thread connecting said weft and said non-woven textile layer; and a heat-bonding adhesive layer on said first face of said non-woven textile layer;

wherein said non-woven textile layer is partially bonded by hot calendaring before associated with said weft;

wherein said weft is formed of threads capable of high shrinkage under the effect of heat, said weft has a rate of shrinkage of between 15% and 40%, and said threads of said weft are curl memory threads made from polyester;

wherein after said weft is connected to said non-woven textile layer by said knitted thread, said weft is subjected to shrinkage treatment conditions to undergo high shrinkage;

wherein said non-woven textile layer has a reduced width and increased mean thickness and volume as a result of said high shrinkage of said weft;

wherein said lining textile has elasticity controlled in a direction perpendicular to said weft and good pliancy in the direction of said weft as a result of said high shrinkage of said weft; and wherein said lining textile has a stretchability determined by said shrinkage treatment conditions.

* * * * *